US012053060B2

(12) United States Patent
Turner et al.

(10) Patent No.: US 12,053,060 B2
(45) Date of Patent: Aug. 6, 2024

(54) BELT BUCKLE

(71) Applicant: Vincent Turner, Camperdown (AU)

(72) Inventors: Vincent Turner, Camperdown (AU); Mark Byass, Stuttgart-Mitte (DE)

(73) Assignee: Vincent Turner, Camperdown (AU)

( * ) Notice: Subject to any disclaimer, the term of this patent is extended or adjusted under 35 U.S.C. 154(b) by 0 days.

(21) Appl. No.: 18/014,390

(22) PCT Filed: Jul. 5, 2021

(86) PCT No.: PCT/AU2021/050715
§ 371 (c)(1),
(2) Date: Jan. 4, 2023

(87) PCT Pub. No.: WO2022/006624
PCT Pub. Date: Jan. 13, 2022

(65) Prior Publication Data

US 2023/0255323 A1 Aug. 17, 2023

(30) Foreign Application Priority Data

Jul. 6, 2020 (AU) ..... 2020902319

(51) Int. Cl.
*A44B 11/22* (2006.01)

(52) U.S. Cl.
CPC ..... *A44B 11/223* (2013.01); *A44D 2203/00* (2013.01)

(58) Field of Classification Search
CPC ..... A44B 11/223; A44B 11/22; A44B 11/006; A44B 11/2592; A44B 11/2584; A41F 1/002; A41F 9/002; A44D 2203/00
See application file for complete search history.

(56) References Cited

U.S. PATENT DOCUMENTS

| | | | | |
|---|---|---|---|---|
| 165,230 A * | 7/1875 | Hayes | A44B 11/22 24/174 |
| 556,413 A * | 3/1896 | Graves | A44B 11/223 24/180 |
| 780,584 A | 1/1905 | Stamper | |
| 862,959 A | 8/1907 | Bean | |
| 1,263,605 A | 4/1918 | Rust | |

(Continued)

FOREIGN PATENT DOCUMENTS

| | | |
|---|---|---|
| WO | 2010012847 | 2/2010 |
| WO | 2017162863 | 9/2017 |

OTHER PUBLICATIONS

International Search Report Dated Sep. 23, 2021.

(Continued)

*Primary Examiner* — Robert Sandy
*Assistant Examiner* — Louis A Mercado
(74) *Attorney, Agent, or Firm* — Preston Smirman; SMIRMAN IP LAW, PLLC

(57) ABSTRACT

A belt has a strap defining a fixed end and a loose end and a buckle engaging the strap. The buckle has a frame defining a channel between outer and inner portions thereof and the outer portion extends beyond the lower portion. A prong protrudes from an undersurface of the outer portion into the channel to engage one of a series of holes of the loose end of the strap passing through the channel. The buckle also has a separable chape connecting the fixed end of the strap and which fits through a rear entrance of the channel to releasably connect to the inner portion of the frame.

14 Claims, 1 Drawing Sheet

(56) References Cited

U.S. PATENT DOCUMENTS

| | | | | | |
|---|---|---|---|---|---|
| 1,852,585 | A | | 4/1932 | McDonald | |
| 2,548,200 | A | * | 4/1951 | Critchley | A44B 11/22 2/322 |
| 2,704,871 | A | | 3/1955 | Bender | |
| 3,030,680 | A | | 4/1962 | Wilhelm | |
| 3,855,637 | A | * | 12/1974 | Luger | A44B 11/006 2/301 |
| 5,673,463 | A | * | 10/1997 | Chih-wen | A44B 11/008 24/265 BC |
| 6,067,692 | A | | 5/2000 | Chang | |
| 6,108,822 | A | * | 8/2000 | Calagui | A41F 9/002 2/338 |
| 6,698,070 | B2 | * | 3/2004 | Chen | A44B 11/006 24/303 |
| 8,365,364 | B2 | * | 2/2013 | Labelson | A44B 11/006 24/316 |
| 9,113,677 | B2 | * | 8/2015 | Anderson | A44B 11/001 |
| 9,743,717 | B2 | * | 8/2017 | Custer | A44B 11/006 |
| 9,872,541 | B2 | * | 1/2018 | Shiao | A41F 9/002 |
| 9,930,935 | B2 | * | 4/2018 | King | A44B 11/006 |
| 10,617,179 | B2 | | 4/2020 | Fiedler et al. | |
| 10,820,665 | B1 | * | 11/2020 | Baber | A44B 11/006 |

OTHER PUBLICATIONS

Written Opinion of International Searching Authority Dated Sep. 23, 2021.

International Preliminary Report on Patentability Dated Jan. 10, 2023.

* cited by examiner

BELT BUCKLE

CROSS-REFERENCE TO RELATED APPLICATION

The instant application is a national phase of PCT International Application No. PCT/AU2021/050715 filed Jul. 5, 2021, and claims priority to Australian Patent Application Serial No. 2020902319 Jul. 6, 2020, the entire specifications of both of which are expressly incorporated herein by reference.

FIELD OF THE INVENTION

This invention relates generally to belt buckles.

BACKGROUND OF THE INVENTION

A belt comprises a buckle attached to a fixed end of a strap and having a clasp to fasten a loose end of the strap in a length adjustable manner.

Belt buckles typically comprise a frame-and-prong design wherein the loose end of the strap going through the frame is engaged by a pivotable prong and the buckle has an integrated chape connecting the fixed end of the strap.

The present invention seeks to provide a belt buckle, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a belt buckle which comprises a frame defining a channel therethrough and a prong protruding therein which engages one of a series of holes of a loose end of a strap passing through the channel.

The buckle further comprises separable chape connecting a fixed end of the strap in which fits within the channel to releasably connect to the frame. The frame defines a rear entrance to the channel between outer and inner portions thereof and the chape fits through the entrance to attach to the inner portion.

The chape may attach to the inner portion under magnetic attraction wherein the chape and the inner portion may comprise respective permanent magnets concealed therein.

The chape may define a clasp which mechanically engages rearwardly against a front edge of the inner portion.

The chape may define a disengagement surface forward of the clasp which, when pressed in a direction towards the outer portion, disengages the clasp.

As such, the present buckle may be easily assembled wherein the chape is inserted through the rearward entrance of the frame of the buckle to snap into place to engage the inner portion of the frame. The loose end of the strap may then be fed through the channel in an opposite direction to engage the prong to secure the belt.

The buckle may be easily disassembled by pushing on the disengagement surface which disengages the clasp of the chape from the front edge of the inner portion of the frame and which also levers the magnets apart to allow the chape to be taken from the entrance.

The clasp of the chape may curve back through 90° or more to resist disconnection when the distal end of the strap is tugged.

The frame may define a gap at the entrance between the outer and inner portions just wide enough to fit the chape and strap adjacently so that the strap prevents the chape disconnecting from the inner portion.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
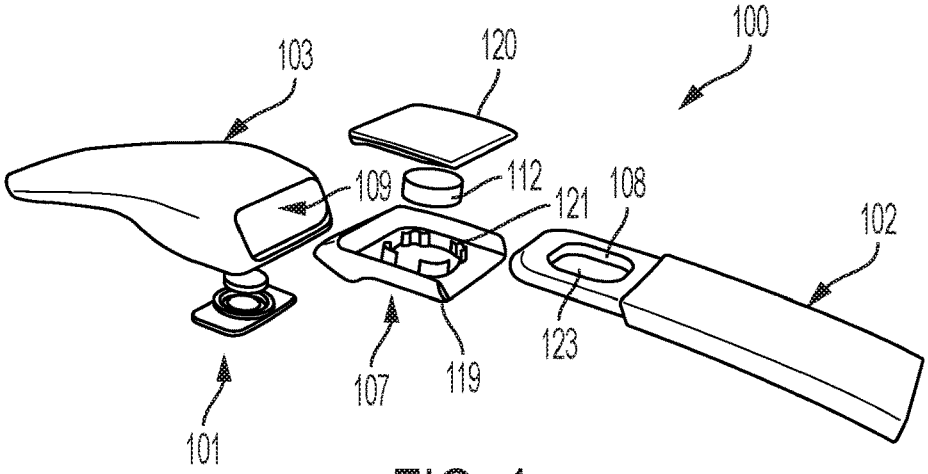
FIG. 1 shows a top perspective view of a disassembled belt in accordance with an embodiment.

A belt 100 comprises a buckle 101 and a strap 102. The buckle 101 comprises a frame 103 defining a channel 104 therethrough and a prong 105 protruding into the channel 104 to engage a hole of a loose end 106 of the strap 102 in a length adjustable manner.

The buckle 101 further comprises a separable chape 107 attaching a fixed end 108 of the strap 102 and which fits within the channel 104 to releasably connect with the frame 103.

The frame 103 defines a rear entrance 109 into the channel 104 between an outer portion 110 (i.e., "outer" meaning away from the user when worn) and an inner portion 111 (i.e., "inner" meaning towards the user when worn). The chape 107 fits through the entrance 109 to attach to the inner portion 111.

The inner portion 111 may magnetically attract the chape 107 against the inner portion 111. In this regard, the inner portion 111 may comprise a permanent magnet 112 therein which magnetically attracts the chape 107. The chape 107 may similarly comprise a permanent magnet 112 therein which magnetically attracts the magnet 112 of the inner portion 111. The magnets 112 are preferably strong magnets, such as rare earth magnets.

The chape 107 may define a clasp 113 which engages rearwardly against a front edge 114 of the inner portion 111. The chape 107 may define a disengagement surface 115 forward of the clasp 113 which, when pressed in a direction towards the outer edge 110, disengages the clasp 113 of the chape 107 from the front edge 114 of the inner portion 111. This action may also lever the magnets 112 apart.

Figure 3:
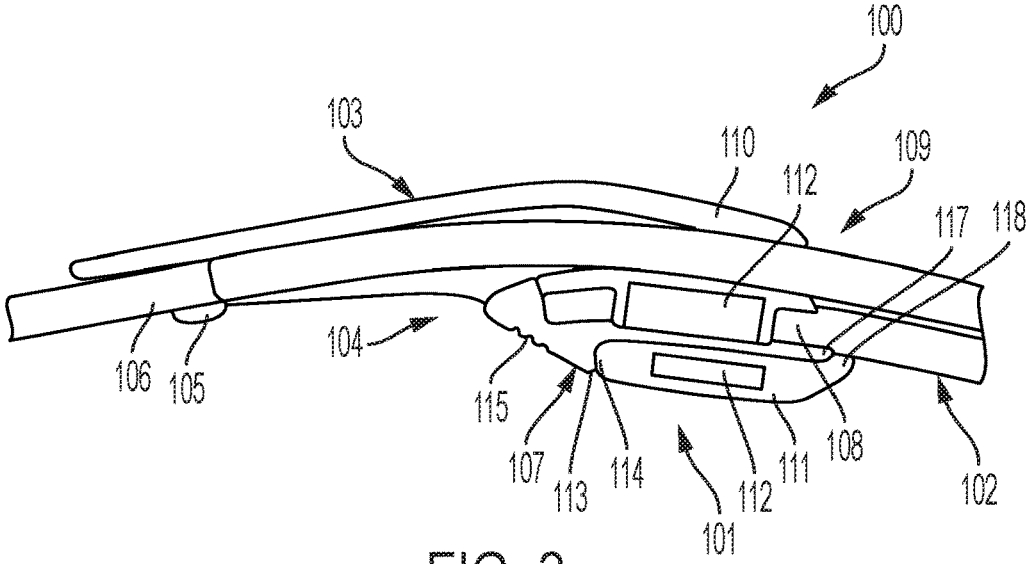
FIG. 3 shows a cross-sectional side elevation view of the belt.

As is apparent from FIG. 3, the clasp 113 may curve back through approximately 90° or more to withstand disengagement when the fixed end 108 of the strap 102 is tugged.

The chape 107 may further define a rearward edge 117 engaging rearwardly against a rearward edge 118 of the inner portion 111.

As is apparent from FIG. 3, the rear entrance 109 may just be wide enough to fit the chape 107 and the strap 102 adjacently so that the strap 102 wedges the chape 107 against the inner portion 111 so that the chape 107 cannot lift from the inner portion 111 to disengage when the strap 102 lies within the channel 104.

The outer portion 110 may extend beyond the inner portion 111 (i.e. away from the entrance 109) and may have a curvature as shown in FIG. 3. The prong 105 may protrude from an undersurface of a distal end of the outer portion 110. The extended outer portion 110 having the prong 105 extending in from a distal end thereof allows the distal end of the outer portion 110 to be prised away from the strap 102 to disengage the prong 105 therefrom.

Figure 2:
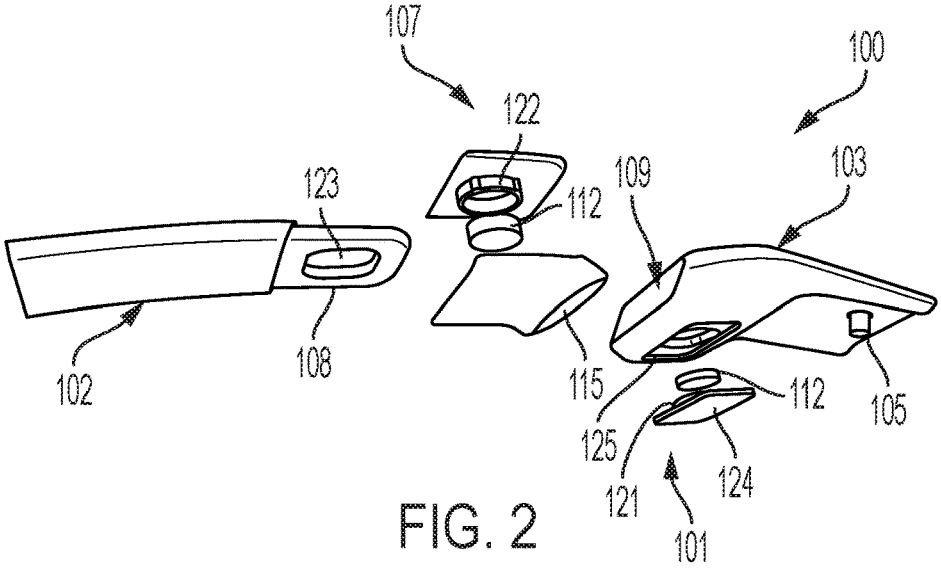
FIG. 2 shows an underside disassembled view of the belt.

As shown in FIGS. 1 and 2, the chape 107 may comprise a disconnectable inner portion 119 and an outer portion 120. The inner portion 119 may comprise a peripheral arrangement of connections formations 121 which clip against a cylindrical portion 122 of the outer portion 120 to engage through an aperture 123 of the distal end 108 of the strap 102 and close around the permanent magnet 112.

The frame 103 may comprise an opening 125 and a plate 124 enclosing the opening 125 and similarly comprising a plurality of formations 121 engaging the permanent magnet 112. However, in alternative embodiments, the frame 103 may be integrally formed and the permanent magnet 112 may be adhered or otherwise affixed to the inner portion 111, preferably within the channel 104 with resin or the like. The permanent magnet 116 may be recessed within inner portion 111 so as to not interfere with the channel.

The buckle 101 may comprise metallic components and the strap 102 may comprise leather and/or rubber. However, in alternative embodiments the buckle 101 may be made of other materials, including plastics and or polymers and even stone or resin. The strap 102 may further be made of various plastics, textiles or leather alternatives.

Using the belt 100 may comprise inserting the chape 107 through the rear entrance 109 of the frame 103 to fix the strap 102 to the frame 103. The magnets 102 may allow the chape 107 to easily snap into place.

Thereafter, the loose end of the strap 102 may be inserted into the frame 103 from the opposite direction and out from the rear entrance 109 and the prong 105 used to engage the strap 102, such as by protruding through one of a series of holes thereof. The distal end of the outer portion 110 (i.e. away from the entrance 109) may be prised away from the loose end of the strap 102 to release the prong 105 therefrom to take off the belt 100 or to adjust the length of the belt.

The belt 100 may be provided with a plurality of different styles of frames 103 and/or straps 102 which may be interchanged and interconnected for differing dress styles.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. A belt, comprising:

a strap defining a fixed end and a loose end; and a buckle engaging the strap, the buckle comprising:

a frame defining a channel between outer and inner portions thereof, the outer portion extending beyond the inner portion, and a prong protruding from an undersurface of the outer portion into the channel to engage the loose end of the strap passing through the channel; and a separable chape connecting the fixed end of the strap and which fits through a rear entrance of the channel to releasably connect to the inner portion of the frame;

wherein the inner portion magnetically attracts the chape against the inner portion;

wherein the inner portion and the chape comprises respective permanent magnets;

wherein the chape defines a clasp which engages rearwardly against a front edge of the inner portion.

2. The belt as claimed in claim 1, wherein the chape defines a disengagement surface forward of the clasp, which disengages the front edge when pressed in towards the outer portion.

3. The belt as claimed in claim 1, wherein the clasp curves back through at least approximately 90°.

4. The belt as claimed in claim 1, wherein the chape defines a rearward edge engaging rearwardly against a rearward edge of the inner portion.

5. The belt as claimed in claim 1, wherein the rear entrance fits the chape and the strap adjacently so that the strap wedges the chape against the inner portion.

6. The belt as claimed in claim 1, wherein the outer portion has curvature.

7. The belt as claimed in claim 1, wherein the chape comprises a disconnectable inner portion and an outer portion which comprise respective connections formations therebetween which engage the permanent magnet and fit through an aperture of the fixed end of the strap.

8. The belt as claimed in claim 1, wherein the frame comprises an opening and a plate enclosing the opening, the plate comprising a plurality of formations engaging the permanent magnet.

9. The belt as claimed in claim 1, wherein the frame is integrally formed and the permanent magnet is affixed to the inner portion.

10. The belt as claimed in claim 9, wherein the permanent magnet is recessed within a surface of the inner portion.

11. The belt as claimed in claim 1, wherein the prong is at a distal end of the outer portion.

12. The belt as claimed in claim 1, wherein the belt comprises at least one of a plurality of interconnectable frames and straps.

13. A belt, comprising:

a strap defining a fixed end and a loose end; and a buckle engaging the strap, the buckle comprising:

a frame defining a channel between outer and inner portions thereof, the outer portion extending beyond the inner portion, and a prong protruding from an undersurface of the outer portion into the channel to engage the loose end of the strap passing through the channel; and a separable chape connecting the fixed end of the strap and which fits through a rear entrance of the channel to releasably connect to the inner portion of the frame;

wherein the inner portion magnetically attracts the chape against the inner portion;

wherein the chape comprises a disconnectable inner portion and an outer portion which comprise respective connections formations therebetween which engage a permanent magnet and fit through an aperture of the fixed end of the strap.

14. A belt, comprising:

a strap defining a fixed end and a loose end; and a buckle engaging the strap, the buckle comprising:

a frame defining a channel between outer and inner portions thereof, the outer portion extending beyond the inner portion, and a prong protruding from an undersurface of the outer portion into the channel to engage the loose end of the strap passing through the channel; and a separable chape connecting the fixed end of the strap and which fits through a rear entrance of the channel to releasably connect to the inner portion of the frame;

wherein the inner portion magnetically attracts the chape against the inner portion;

wherein the frame comprises an opening and a plate enclosing the opening, the plate comprising a plurality of formations engaging a permanent magnet.

* * * * *